United States Patent [19]

Collins

[11] 4,428,486

[45] Jan. 31, 1984

[54] SELF-BALANCING BELT CADDY

[76] Inventor: Wesley A. Collins, 18417 S. Van Ness Ave., Torrance, Calif. 90504

[21] Appl. No.: 361,291

[22] Filed: Mar. 24, 1982

[51] Int. Cl.[3] ..... A47F 5/08

[52] U.S. Cl. ..... 211/119; 211/59.1

[58] Field of Search ..... 211/119, 60 R, 113, 211/61, 59.1, 57.1, 106

[56] References Cited

U.S. PATENT DOCUMENTS

| | | | |
|---|---|---|---|
| 1,663,366 | 3/1928 | Berry | 211/119 |
| 4,253,576 | 3/1981 | Ford et al. | 211/59.1 X |
| 4,282,976 | 8/1981 | Fitzgerald | 211/59.1 |

FOREIGN PATENT DOCUMENTS

| | | | |
|---|---|---|---|
| 270606 | 5/1927 | United Kingdom | 211/106 |

*Primary Examiner*—Ramon S. Britts
*Assistant Examiner*—Blair M. Johnson
*Attorney, Agent, or Firm*—Charmasson & Holz

[57] ABSTRACT

A belt caddy utilizes a frame defining a traveler bar formed into an elongated rectangular loop bent in the center to create a pair of parallel, V-shaped portions the arms of which mount the eyelets of hanging hooks which ride on the traveler bar, the traveler being suspended over its center, above the two vertices of the V-shaped members, so that belts hooked on the hanging hooks will slide down on the traveler bar, centrally of the unit and be suspended beneath the hook, aligned with the center of gravity of the device so that it will not tend to skewer to one side due to the moment arm caused by the addition of a belt.

5 Claims, 4 Drawing Figures

SELF-BALANCING BELT CADDY

BACKGROUND AND SUMMARY OF THE INVENTION

The invention is in the field of organizers and hangers, and is somewhat related to a co-pending application for a specialized tie-hanging rack. In that application, the problem of scores of ties hanging all over the closet has been addressed. The present disclosure addresses the similar problem experienced with belts. Although most people have more ties than belts and for that reason ties are a problem, belts are nevertheless in ways even more insidious, inasmuch as they all tend to be different from one another, and some will not fit on conventional hooks. Also, it is usually not practical to hang belts on a coat hanger, at least unless they are actually looped and buckled around the bottom rung of the coat hanger, which is obviously too much trouble.

The instant invention completely solves the above stated belt litter problem by providing a belt caddy, which can either be hooked on a wall or suspended on a closet crossbar, which has a number of hooks slideably engaged on a traveler bar. The traveler bar is defined as a continuous loop, with parallel V-shaped side bars so that the belts will tend to gravitate toward a central position on the caddy, rather than skewering just to one side. The main suspending hook is swivel-mounted atop a central stem, to permit rotation of the body part of the caddy in any direction to facilitate access to belts on the caddy in confined places, such as in a crowded closet.

DETAILED DESCRIPTION OF THE PREFERRED EMBODIMENT

Figure 1:
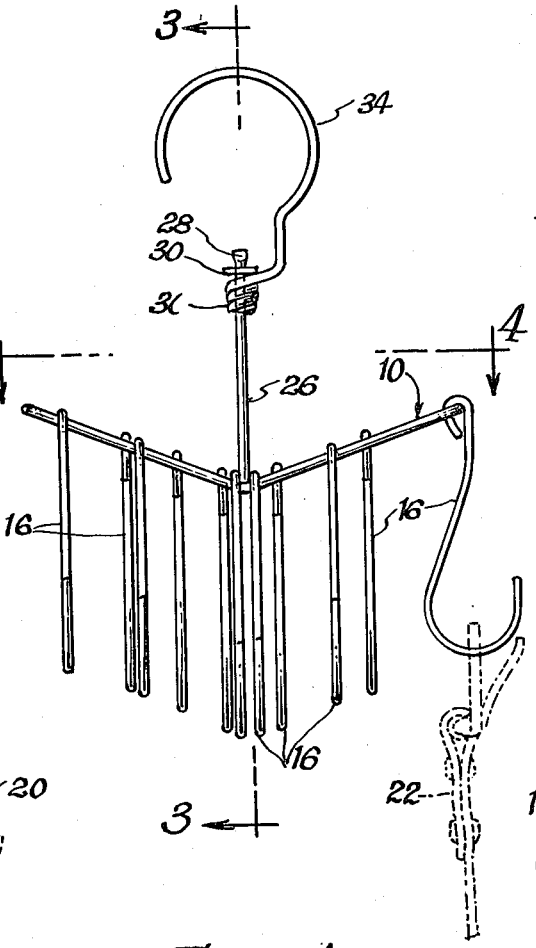
FIG. 1 is a front elevation view of the caddy.
Figure 2:
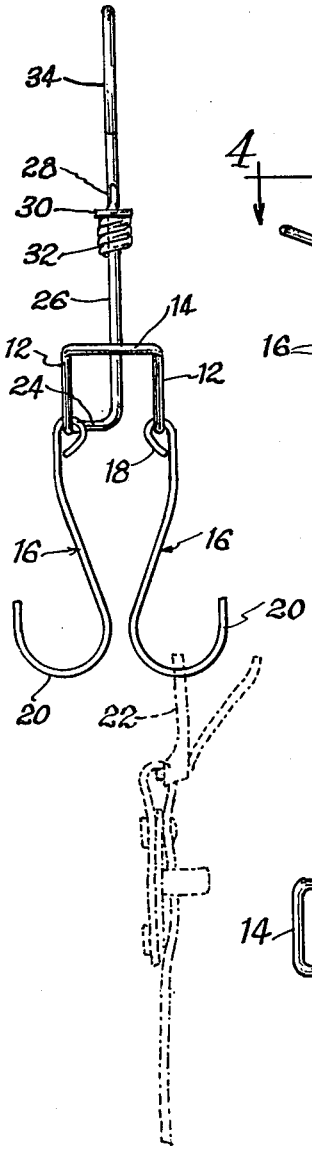
FIG. 2 is a side elevation view of the caddy.
Figure 3:
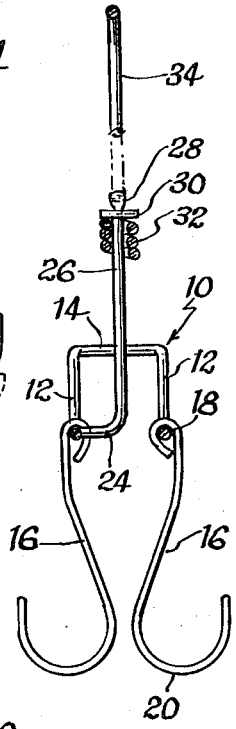
FIG. 3 is a section taken along line 3—3 of FIG. 1.
Figure 4:
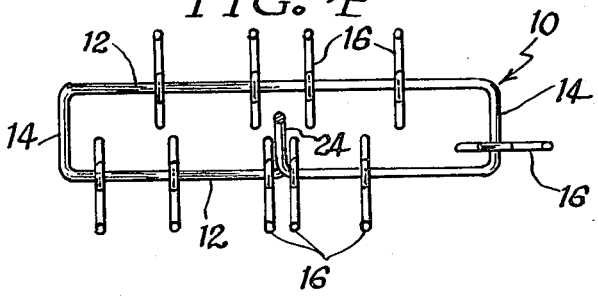
FIG. 4 is a section taken along line 4—4 of FIG. 1.

The main body of the caddy is formed from a single length of wire which is bent to form a rectangular loop 10 made of two V-shaped side bars 12 and end pieces 14, which together define a continuous loop traveler bar which is rectangular in plan form as shown in FIG. 4. Thus there is no means of escape for the hooks 16 which are engaged through eyelets 18 on the traveler bar. The lower ends of the hooks 16 are curved at 20 to facilitate engagement of belts 22.

The piece of wire that is used to define the closed loop 10 also extends inwardly at 24 and then bends upwardly to define a stem 26. The top of the stem is crimped at 28 and mounts coiled collar 32 of the mounting hook 34. Although this hook is made large enough to engage over the crossbar in a closet, it can also be engaged over a wall nail or the equivalent. When mounted in this fashion, the stem extends at a slightly non-vertical angle, with the outermost of the traveler side bars 12 being the one ordinarily used to engage the belts. The hanging hook is retained by retainer washer 30, so that the coiled collar 32 freely pivots around the stem 26 to make the caddy generally more adapted to different circumstances.

The caddy is small, lightweight, and can be conveniently carried in a suitcase for use in motels, and fulfills a longstanding need experienced by virtually every modern man and provides a neat, simple means of organizing the array of belts maintained by most men.

While the preferred embodiment of the invention has been described, other modifications may be made thereto and other embodiments may be deviced within the spirit of the invention and scope of the appended claims.

What is claimed is:

1. A self-balancing belt caddy comprising:

a V-shaped frame having two traveler arms extending obliquely, upwardly and symmetrically from a medially vertical axis passing through the vertex of the frame and through the center of gravity of the caddy when said caddy is suspended;

means extending upwardly from said vertex and along said axis to suspend said frame from a fixed support;

a plurality of hooks having eyelets slidingly engaged on said traveler arms, said hooks being free to gravitate toward said vertex to balance said caddy when supporting a load; and wherein each of said traveler arms includes two parallel bars having their tips spanned by end segments so that said bars and segments define a continuous loop and said hooks are captured on said loop in sliding relation along said traveler arms.

2. A self-balancing belt caddy comprising:

a frame;

means to suspend said frame from a fixed support;

a traveler bar defined by said frame and being generally V-shaped with the vertex thereof being substantially vertically aligned with the center of gravity of said caddy when said caddy is suspended;

said bar having arms upwardly extended from the vertex thereof, and including a plurality of hooks having eyelets engaged on said traveler bar, whereby upon engaging a belt on one of said hooks, the latter will gravitate toward said vertex to balance said caddy;

said traveler bar including two parallel V-shaped portions with their tips spanned by end segments so that said traveler bar defines a continuous loop, and said hooks are captured in said loop in sliding relation to said traveler; and wherein said frame includes an upright stem extending upwardly from a bent connector length extending from one of the vertices of said V-shaped portions, with the top of said stem mounting said means.

3. Structure according to claim 2 wherein said means to suspend is a mounting hook, swivel-mounted to said stem for rotation about the stem axis.

4. Structure according to claim 3 wherein said loop and stem are defined by a continuous piece of wire.

5. Structure according to claim 4 wherein said mounting hook is defined by a continuous piece of wire with a coiled collar at the lower end to receive the top of said stem in swiveling relationship.

* * * * *